US005501551A

United States Patent [19]

Wright

[11] Patent Number: 5,501,551

[45] Date of Patent: Mar. 26, 1996

[54] MINE ROOF EXPANSION ANCHOR, EXPANSIBLE SHELL ELEMENT USED THEREIN AND METHOD OF INSTALLATION

[75] Inventor: Raymond L. Wright, Syracuse, N.Y.

[73] Assignee: The Eastern Company, Naugatuck, Conn.

[21] Appl. No.: 409,407

[22] Filed: Mar. 24, 1995

[51] Int. Cl.[6] ..... E21D 20/02

[52] U.S. Cl. ..... 405/259.4; 405/259.6; 411/33; 411/82

[58] Field of Search ..... 405/259.4, 259.5, 405/259.6, 259.1; 411/18, 33, 55, 82, 71, 72

[56] References Cited

U.S. PATENT DOCUMENTS

| | | | |
|---|---|---|---|
| 4,299,515 | 11/1981 | Yates et al. | 405/259.6 X |
| 4,861,198 | 8/1989 | Stankus | 405/259.6 X |
| 5,009,549 | 4/1991 | Stankus | 405/259.4 X |
| 5,316,414 | 5/1994 | Wright | 405/259.5 X |
| 5,352,066 | 10/1994 | Schaeffer et al. | 405/259.4 X |

FOREIGN PATENT DOCUMENTS

| | | | |
|---|---|---|---|
| 163232 | 6/1955 | Australia | 405/259.4 |

*Primary Examiner*—Stephen J. Novosad
*Attorney, Agent, or Firm*—Charles S. McGuire

[57] ABSTRACT

A mechanical expansion anchor and radially expansible shell for use therein having particular application in combination with resin grouting materials. The anchor includes a conventional, tapered camming plug moveable axially upon a mine roof bolt to move the shell leaves outwardly into gripping engagement with the drill hole wall. The shell is distinguished by the provision of grooves in the outer surfaces of the shell leaves, extending between the upper and lower ends of the leaves. Components of a resin mix inserted into the drill hole in advance of the expansion anchor, carried on the end of the bolt, flow through the grooves in the outer leaf surfaces to the area below the anchor.

21 Claims, 2 Drawing Sheets

MINE ROOF EXPANSION ANCHOR, EXPANSIBLE SHELL ELEMENT USED THEREIN AND METHOD OF INSTALLATION

BACKGROUND OF THE INVENTION

The present invention relates to mine roof expansion anchors of the type having a radially expansible shell and a tapered plug moveable axially within the shell to effect expansion thereof. More specifically, the invention relates to novel structures of mine roof expansion anchors and tapered plug elements thereof for installation together with a resin grouting mix in a drill hole in a mine roof, or the like, and to methods of installation of combined resin-mechanical anchors.

For many years, one of the most popular means of providing support and reinforcement to mine roofs and other subterranean structures has been the mechanical expansion anchor. Such anchors have been proposed in a wide variety of designs having in common a radially expansible shell portion and a tapered plug having an internally threaded, axial bore. The threaded end of a bolt or other elongated rod is engaged with the bore of the tapered plug and the shell is suitably supported in surrounding relation to the smaller end of the plug. The end of the rod carrying the anchor is inserted into a pre-drilled hole in the rock structure, and the shell is expanded into tight engagement with the drill hole wall by rotation of the bolt to move the larger portion of the plug into the shell.

More recently, the effectiveness and useful life of anchorages have been enhanced by the use of quick-setting resin grouting mixes conjointly with mechanical anchors. Such mixes are commercially available in elongated, breakable tubes or cartridges having a diameter approximating that of the drill hole, and separate compartments containing a resin and a catalyst which are in a flowable condition prior to mixing. The lengths of the resin cartridge and bolt are so related to the depth of the drill hole that forced insertion of the bolt crushes the cartridge against the end of the drill hole, releasing the two components which are mixed to the extent necessary as they pass through and around the anchor and end of the bolt, and by rotation of the bolt to move the plug axially into the shell. Upon mixing of the components, the grouting mix hardens in a few seconds.

Since the resin cartridge is positioned between the blind end of the drill hole and the upper end of the expansion anchor, the components of the grouting mix must flow around and/or through the anchor components when the cartridge is broken. Ideally, the cured grouting mix should surround at least those portions of the anchor components not in direct, compressive engagement with the drill hole wall, as well as the upper portion of the bolt, usually to a position somewhat below the lower end of the anchor. Expansion anchors disclosed in a number of U.S. patents, including U.S. Pat. Nos. 4,859,118, 4,969,778 and 5,009,549, provide resin flow passages in the form of axial grooves in the tapered plug between the surfaces thereof which engage the inner surfaces of the shell. In the anchor of applicant's U.S. Pat. No. 5,316,414, resin flow passages are provided by axial grooves in the opposing wedge and/or shell surfaces.

It is a principal object of the present invention to provide a mine roof expansion anchor having novel and improved means for flow of resin mix components around and through the shell.

Another object is to provide an improved expansion shell for a mine roof anchor which enhances performance of the anchor, particularly when used with a resin grouting mix.

A further object is to provide an expansion shell with uniquely positioned resin flow passages for use in combined resin-mechanical anchorages for rock structure supports.

Still another object is to provide a novel method of anchoring the distal end of a mine roof bolt in a drill hole using both a mechanical anchor and resin to achieve enhanced performance.

Other objects will in part be obvious and will in part appear hereinafter.

SUMMARY OF THE INVENTION

In accordance with the foregoing objects, the invention is embodied in a mechanical expansion anchor having the usual plurality of circumferentially spaced leaves or fingers which are radially expansible by axial movement therebetween of a tapered nut or camming plug in response to rotation of an elongated bolt threadedly engaged with the tapered plug. The end of the bolt carrying the anchor is inserted into a preformed drill hole in the rock formation to be supported with a resin grouting mix, preferably in a two-compartment cartridge, inserted between the anchor and the blind end of the drill hole.

The expansion shell leaves have the usual smooth inner surfaces for contact with the compression surfaces of the camming plug, and radially extending serrations or teeth for contact with the drill hole wall. The shell of the present invention is distinguished from the prior art by at least one groove in the external surface of at least one leaf providing a passageway for flow of resin mix components from the upper to the lower end of the shell. The groove is at least as deep as the height of the individual serrations on the outer shell surface. Preferably, at least one groove is provided in each shell leaf, extending axially for at least the serrated portion of the leaf surface.

The method of the invention involves causing a portion of the resin components to flow through passages in the areas between the opposing surfaces of the shell leaves and the drill hole wall.

DETAILED DESCRIPTION

Figure 1:
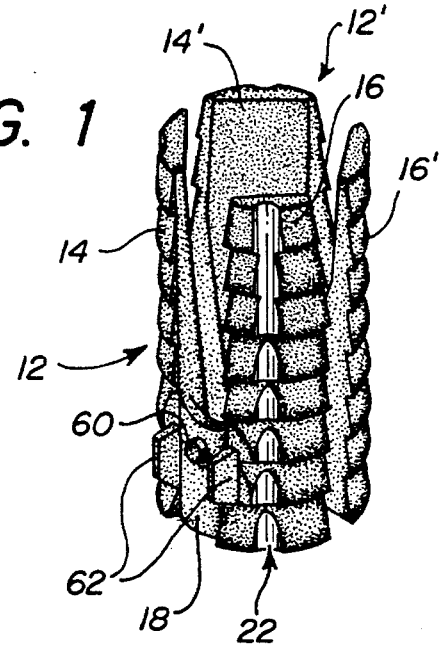
FIG. 1 is a perspective view of an expansion shell element of a mine roof expansion anchor embodying the present invention.

Referring now to the drawings, in FIGS. 1–4 is shown a preferred embodiment of the expansion shell of the present invention, denoted generally by reference numeral 10. In the illustrated embodiment, shell 10 includes two, physically separate, essentially identical halves 12, 12' each having two leaves with a series of serrations extending radially outwardly at equally spaced intervals over the entire length of each leaf. The same reference numerals are used to denote corresponding portions of the two shell halves, those numerals for one shell half including a prime sign.

Shell halves 12, 12' each include a pair of leaves 14, 14' and 16, 16' integrally joined at what is termed their lower ends by bridging portions 18, 18'. Each of shell halves 12, 12' has upper and lower ends and each of leaves 14, 14', 16, 16' have respective, inner and outer surfaces. In accordance with the usual practise in the design of mine roof expansion anchor shells, the leaf outer surfaces are formed with a plurality of radially extending teeth or serrations, while the inner surfaces are essentially smooth for sliding contact with opposing surfaces of a conventional, tapered, camming plug.

Figure 4:
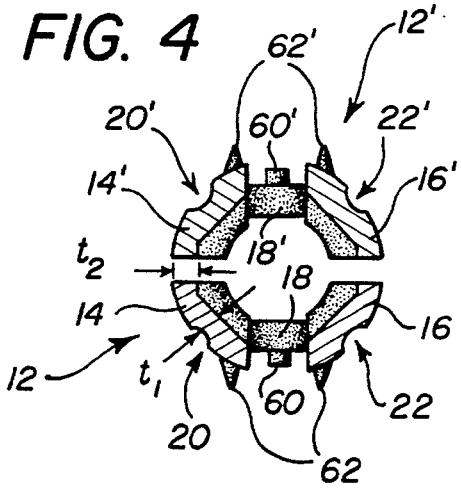

The expansion shell of the present invention is distinguished from prior art shells by the presence of grooves providing passageways in the outer surfaces extending between the upper and lower ends of the leaves. In the illustrated embodiment, each of leaves 14, 14' and 16, 16' includes a single groove 20, 20' and 22, 22', respectively, extending linearly between the upper and lower ends thereof. The illustrated grooves are essentially identical to one another, each being arcuate in plan view (FIGS. 4 and 7) and having an inner end extending longitudinally substantially parallel to the central axis of the shell, as indicated by lines X—X and Y—Y in FIG. 3. The depth of the grooves is preferably at least as great as the height of the serrations on the outer shell surface through which the grooves extend to ensure longitudinal continuity of the grooves. However, the minimum thickness $t_1$ within the grooves is preferably not more than a few thousandths of an inch less than the thickness $t_2$ at the edges of the leaves (FIG. 4).

Figure 5:
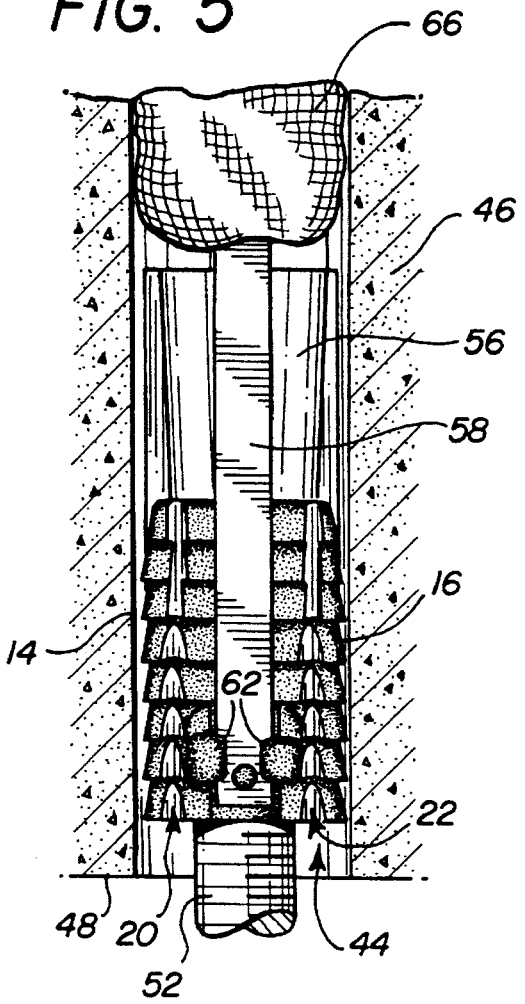
FIG. 5 is a front elevational view of an assembled mine roof expansion anchor including the shell of FIGS. 1–4, inserted into a drill hole in a mine roof together with a resin cartridge.
Figure 6:
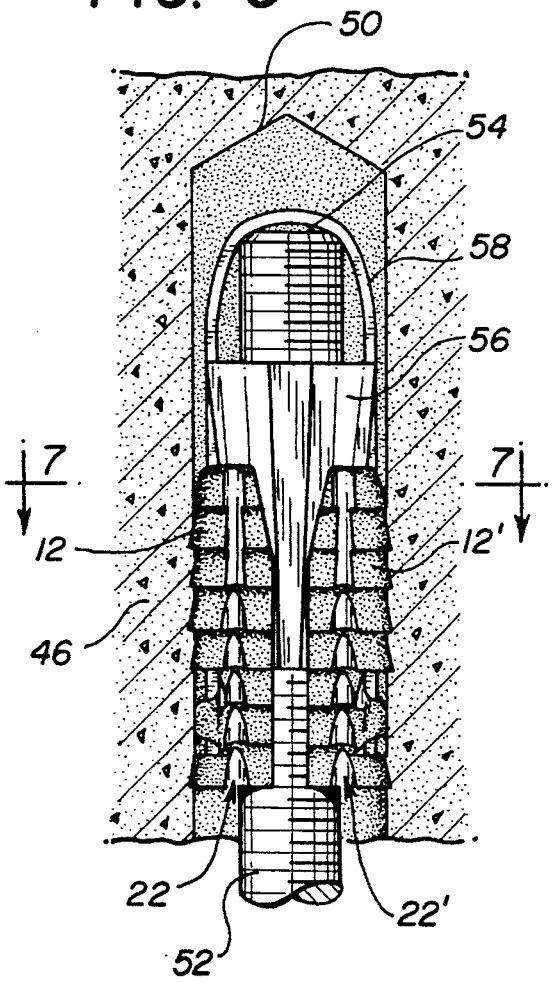
FIG. 6 is a front elevational view, showing the anchor assembly of FIG. 5 fully installed in a drill hole with the resin components.
Figure 7:
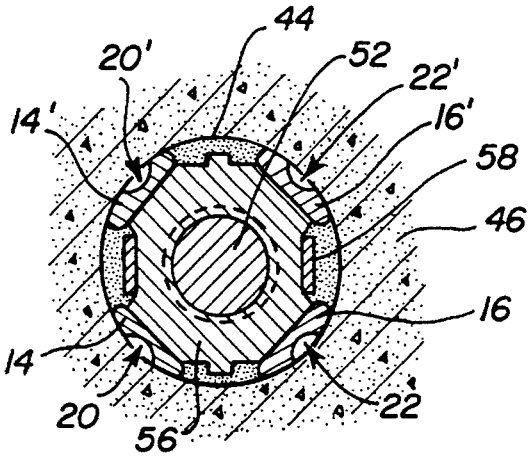
FIG. 7 is a top plan view in section on the line 7—7 of FIG. 6.

Turning now to FIGS. 5–7, the expansion shell of FIGS. 1–4 is shown as part of a typical anchorage system for a mine roof bolt. Drill hole 44 is formed in rock structure 46, extending from surface 48 (FIG. 5) to a blind end 50 (FIG. 6). Drill hole 44 has a depth an inch or so greater than the length of the portion of bolt 52 positioned in the hole. Bolt 52 has threads extending from distal end 54 for a portion of its length to mate with the internal threads of a central bore in conventional tapered camming plug 56. The proximal end of bolt 52 (not shown) has an integral head or other means for engagement by a power wrench to effect insertion and rotation of the bolt in a well-known manner, thereby urging a bearing plate carried by the proximal end of the bolt into tight engagement with surface 48 and tensioning the bolt.

Figure 2:
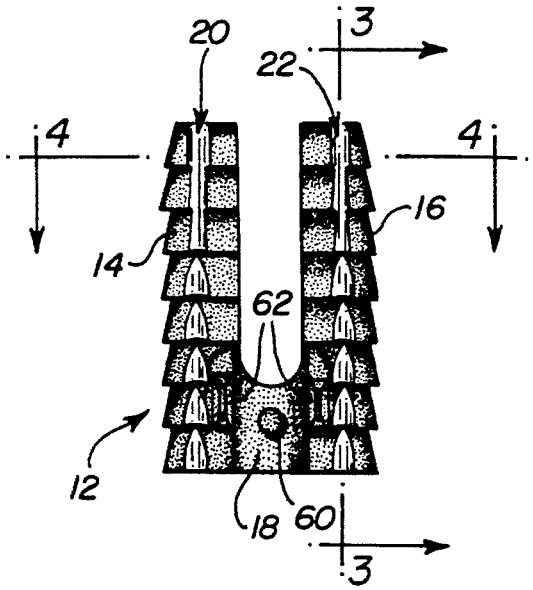
FIG. 2 is a front elevational view of the shell.
Figure 3:
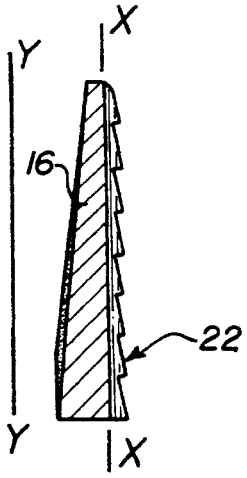
FIGS. 3 and 4 are sectional views on the lines 3—3 and 4—4, respectively, of the shell of FIG. 2.

In the illustrated form, the mechanical expansion anchor includes bail element 58 having a medial portion with elongated legs extending from opposite sides thereof. The leaves of the respective shell halves are separated by gaps through which opposite legs of bail element 58 extend. The shell halves are maintained in assembled relation with one another and with tapered plug 56 by bail element 58, with the small end of the plug extending into the upper end of the shell structure. Studs 60, 60' on bridge portions 18, 18' extend through openings near the terminal ends of the bail legs; after the bail legs are so placed, tabs 62, 62', shown in their initial, outwardly extending condition in FIGS. 1, 2 and 5, are bent toward one another to partially cover and maintain the bail legs in assembled relation with the shell halves, as seen in FIG. 5.

A commercially available form of breakable cartridge 66, holding two components of a resin grouting mix in separate compartments, is inserted into drill hole 22 ahead of distal end 54 of bolt 52, carrying the mechanical expansion anchor. As bolt 52 is forcibly pushed into drill hole 44 to bring distal end 54 of the bolt near blind end 50 of the drill hole, cartridge 66 is ruptured, releasing the components which are initially in a flowable state. The grouting mix components around plug 56, through the gaps between shell leaves and shell halves, and through grooves 20, 20', 22 and 22'.

After bolt 52 is fully inserted, it is rotated by the aforementioned power wrench in a direction causing plug 56 to travel axially down the bolt threads, forcing the progressively larger portion of the plug into the space surrounded by the shell leaves. In so doing, outer surface portions of plug 56 slidingly engage the opposing, internal surfaces of the leaves, forcing the serrated, external surfaces of the leaves into gripping engagement with the wall of drill hole 44. Rotation of the shell is inhibited by frictional engagement of its outer surface with the drill hole wall, and rotation of the plug is inhibited by engagement of ribs on opposite sides of the plug in the gaps between the shell halves. Continued application of torque to bolt 52 up to a predetermined maximum tensions the bolt to a desired degree to compress and reinforce the rock strata. The two components of the resin grouting are mixed to the degree necessary to initiate hardening by the hydraulic pressures developed as cartridge 66 breaks, by their flow around the plug and through the shell groove and by rotation of bolt 52. In a typical installation, only about 3 seconds of bolt rotation is required and hardening of the resin grout is essentially complete in about 10 seconds.

It will be understood that the invention may be practised with a wide variety of anchor designs, in addition to the embodiment illustrated herein. These include not only bail-type anchors, but also those having a unitary shell structure initially held in position by a support nut on the bolt. Also, the number of shell leaves may be other than four. The resin grooves may be other than arcuate in plan view, e.g., triangular, and more than one groove may be provided in one or more of the leaves. The grooves may extend from top to bottom of the shell angularly or spirally with respect to the shell axis, rather than parallel. Furthermore, the grooves may be of variable width, with portions defining relatively narrower or wider passageways for resin flow. In any case, a further advantage provided by the invention is that the sharp edges at each side of the grooves tend to engage the drill hole wall as the bolt is rotated, thereby inhibiting undesired rotation of the shell.

What is claimed is:

1. An expansion anchor shell element for engagement with the wall of a bore hole to anchor therein an elongated rod, said shell element comprising:

a) a plurality of leaves, each elongated between upper and lower ends and each having opposite side edges;

b) means for maintaining said leaves in assembled relation, substantially symmetrically arranged about a central axis with inner surfaces facing toward and outer surfaces facing away from said central axis;

c) means defining a passageway extending into said outer surface, continuously between said upper and lower ends, of at least one of said leaves, whereby the spaces within said bore hole above and below said one leaf communicate through said passageway when said outer surface of said one leaf is engaged with said bore hole wall.

2. The shell element of claim 1 wherein at least one of said passageways extends between said upper and lower end of each of said leaves.

3. The shell element of claim 2 wherein each of said passageways extends substantially linearly between said upper and lower ends.

4. The shell element of claim 1 wherein at least a portion of said means for maintaining said leaves in assembled relation comprises a bridge portion integrally connecting at least one pair of said leaves adjacent said lower ends thereof.

5. The shell element of claim 1 wherein said outer surface of each of said leaves includes a series of serrations comprising surface portions sloping outwardly toward said lower end to edge portions and extending radially inwardly from said edge portions to meet the next of said sloping surface portions.

6. The shell element of claim 5 wherein said edge portions lie in planes substantially normal to said central axis, defining a vertically spaced series of laterally extending, toothlike projections each having a predetermined height.

7. The shell element of claim 6 wherein said passageway comprises a groove extending into said outer surface to a depth at least as great as said predetermined height of the highest of said projections.

8. The shell element of claim 6 wherein said passageway comprises a groove extending into said outer surface to a depth greater than said predetermined height of the projection having the greatest height.

9. The shell element of claim 1 wherein said passageway comprises a groove extending into said outer surface continuously between said upper and lower ends to a depth wherein the minimum thickness of said one leaf between said inner surface and any portion of said groove is not more than a few thousandths of an inch less than the thickness at said upper end of said side edges.

10. The shell element of claim 9 wherein one of said grooves extends into said outer surface of each of said leaves continuously between said upper and lower ends to a depth wherein the minimum thickness of each of said leaves between said inner surface and any portion of said groove is not more than a few thousandths of an inch less than the thickness at said upper end of said side edges.

11. The shell element of claim 10 wherein each of said grooves extends substantially linearly between upper and lower ends of each of said leaves.

12. A mechanical expansion anchor for securing a threaded end of a mine roof bolt in a blind drill hole of a rock formation, said anchor comprising:

a) a hollow shell portion having a plurality of leaves, each having an inner and an outer surface and an upper and a lower end, arranged about a central axis, said leaves being substantially radially expansible with respect to said axis to bring said outer surfaces into tightly gripping engagement with the wall of said drill hole;

b) a tapered camming plug having an internally threaded bore for threaded engagement with said end of said bolt for axial movement of said plug with respect to said shell in response to rotation of said bolt to effect said radial expansion; and c) at least one flow passage extending into said outer surface of at least one of said leaves to permit passage of a flowable material from the area above said upper end to below said lower end of said one leaf when said outer surfaces of said leaves are in said tightly gripping engagement with said bore hole wall.

13. The expansion anchor of claim 12 wherein said flow passage comprises a continuous groove having a first and a second end respectively communicating with said areas above and below said upper and lower ends of said one leaf.

14. The expansion anchor of claim 13 wherein said groove extends substantially linearly between said first and second ends.

15. The expansion anchor of claim 12 wherein at least one of said flow passages extends into said outer surface of each of said leaves.

16. The expansion anchor of claim 15 wherein each of said flow passages comprises continuous grooves each having a first and a second end respectively communicating with said areas above and below said leaves.

17. Anchoring means for securely holding the distal end of a mine roof bolt in a blind drill hole of predetermined diameter, said anchoring means comprising:

a) a rupturable resin cartridge having separate compartments containing respective components of a hardenable resin grouting mix initially in a flowable state;

b) a shell portion having a plurality of elongated leaves each having an inner and an outer surface and upper and lower ends;

c) means supporting said leaves substantially symmetrically about a central axis with adjacent leaves circumferentially spaced from one another;

d) a tapered plug element having upper and lower ends of respectively larger and smaller cross dimensions, said plug lower end extending into the space surrounded by said leaf upper ends and said plug upper end being sufficiently large for expanding said leaves radially outwardly into tightly gripping engagement with the wall of said drill hole upon movement of said plug upper end into said space; and e) at least one flow passage extending into said outer surface of at least one of said leaves for passage of said components from said upper to said lower end of said one leaf when the latter is in said tightly gripping engagement with the wall of said drill hole.

18. The anchoring means of claim 17 wherein said flow passage comprises a continuous groove having a first and a second end respectively communicating with said areas above and below said upper and lower ends of said one leaf.

19. The anchoring means of claim 17 wherein at least one of said flow passages extends into said outer surface of each of said leaves.

20. The method of anchoring the distal, threaded end of a mine roof bolt in a blind drill hole of predetermined diameter, said method comprising:

a) supporting a radially expansible shell with a plurality of elongated leaves, each having an inner and an outer surface and an upper and a lower end, in substantially symmetrical, surrounding relation to said bolt end with said inner surfaces in spaced relation thereto and the outermost portions of said outer surfaces lying on a circle of not greater than said predetermined diameter;

b) threadedly engaging a tapered plug with said bolt end, said plug having a small end extending from said leaf upper ends into the space between said bolt and said leaf inner surfaces, a large end having a cross-dimension sufficient when moved into said space to move said leaf outer surfaces outwardly into tightly gripping engagement with the wall of said drill hole;

c) providing at least one, continuous flow passage extending into said outer surface of at least one of said leaves for passage of a flowable material from said upper to said lower end of said one leaf when the latter is in said tightly gripping engagement with the wall of said drill hole;

d) inserting into said drill hole a rupturable cartridge having separate compartments containing respective components of a hardenable resin grouting mix initially in a flowable state;

e) advancing said distal end of said bolt, with said plug and said shell thereon, into said drill hole behind said cartridge to rupture said cartridge against the blind end of said drill hole and release said components and causing flow of at least a portion thereof through said flow passage; and f) rotating said bolt to move said plug axially thereon and move said leaf outer surfaces outwardly into tightly gripping engagement with said bore hole wall.

21. The method of claim 20 and further comprising providing a flow passage extending into said outer surface of each of said leaves and causing flow of a portion of said components through each of said flow passages.

* * * * *